US005558156A

United States Patent [19]

Tsutsui

[11] Patent Number: 5,558,156

[45] Date of Patent: Sep. 24, 1996

[54] HEAT EXCHANGER

[75] Inventor: Toshihiro Tsutsui, Wako, Japan

[73] Assignee: Honda Giken Kogyo Kabushiki, Tokyo, Japan

[21] Appl. No.: 360,926

[22] Filed: Dec. 21, 1994

[30] Foreign Application Priority Data

Jan. 21, 1994 [JP] Japan ..... 6-005282

[51] Int. Cl.[6] ..... F28D 11/06

[52] U.S. Cl. ..... 165/84; 165/122; 165/152

[58] Field of Search ..... 165/152, 84, 122

[56] References Cited

U.S. PATENT DOCUMENTS

| | | | |
|---|---|---|---|
| 3,265,127 | 8/1966 | Nickol et al. | 165/152 |
| 4,406,323 | 9/1983 | Edelman | 165/84 |
| 4,469,168 | 9/1984 | Itoh et al. | 165/152 |
| 4,501,319 | 2/1985 | Edelman et al. | 165/84 |
| 4,595,338 | 6/1986 | Kolm et al. | 416/81 |
| 4,693,307 | 9/1987 | Scarselletta | 165/152 |
| 4,892,143 | 1/1990 | Ishii | 165/152 |
| 4,923,000 | 5/1990 | Nelson | 165/122 |
| 5,335,143 | 8/1994 | Maling, Jr. et al. | 165/122 |

FOREIGN PATENT DOCUMENTS

| | | | |
|---|---|---|---|
| 0014050 | 2/1979 | Japan | 165/84 |
| 0014049 | 2/1979 | Japan | 165/84 |

*Primary Examiner*—John Rivell
*Assistant Examiner*—Christopher Atkinson
*Attorney, Agent, or Firm*—Armstrong, Westerman, Hattori, McLeland & Naughton

[57] ABSTRACT

A heat exchanger has heat exchange members for performing heat exchanging with a fluid to flow along surfaces thereof. Fins are fixed, at only one end thereof in the direction of flow of the fluid, to the respective heat exchange members in a cantilevered manner. Each of the fins has a piezoelectric material layer laminated on at least one of the surfaces of each fin. Vibrations are given to the fins, with the fixed end thereof operating as a fulcrum, by applying an alternating voltage to the piezoelectric material layer such that the fins are extended and contracted in the direction of the flow of the fluid. As a modified example, each fin may be provided at its rear end with a weight. Piezoelectric actuators are disposed inside a frame in which the heat exchanger is contained, in a manner to pinch the heat exchanger in a vertical direction. By causing the actuators to vibrate, the fins are also vibrated.

5 Claims, 5 Drawing Sheets

HEAT EXCHANGER

BACKGROUND OF THE INVENTION

1. Field of the Invention

The present invention relates to a heat exchanger which is used in an air conditioner or the like.

2. Description of Related Art

The heat exchanger is normally provided with plate-like members for exchanging heat (or plate-like heat exchange members) which perform heat exchanging with a fluid such as air or the like which flows along surfaces thereof.

Attempts have so far been made to improve an efficiency of heat exchanging (or a heat exchange efficiency) by devising the shape of the heat exchange members. For example, as shown in FIG. 14, there is known a heat exchanger in which louver-like fin portions b are formed in the heat exchange members "a" so that the heat exchange efficiency can be improved by a leading-edge effect (i.e., an effect to be attained by the leading edge) of each of the fins b.

Even if the fins are formed as described above, there will be generated a speed boundary layer of lower speed on the surfaces of the fins due to the friction of the fluid with the fins when the fluid flows from the leading edge of each of the fins towards the trailing edge thereof. As a result, the fluid on the surfaces of the fins becomes hardly replaced or interchanged. Further, there will occur a deficit in flow speed (or a flow speed deficit) in the neighborhood of the surfaces of the fins, resulting in a pressure loss. Especially, that portion of a boundary layer which is very close to the surfaces of the fins and which is subjected to the influence of the adsorbing phenomenon of the fluid molecules will not be eliminated or will not disappear even if the shape of the fins were changed. This fact has been a hindrance to an attempt to improve the heat exchange efficiency.

In view of the above-described points, the present invention has an object of providing a heat exchanger which can improve the heat exchange efficiency by eliminating the speed boundary layer.

SUMMARY OF THE INVENTION

In order to attain the above and other objects, the present invention is a heat exchanger having heat exchange members for performing heat exchanging with a fluid to flow along surfaces thereof. The heat exchanger comprises: fins each of which is fixed, at only one end thereof in a direction of flow of the fluid, to respective heat exchange members in a cantilevered manner; and driving means for driving each of the fins to cause vibrations with one end of each of the fins operating as a fulcrum.

By the vibration of the fins, the fluid molecules in the neighborhood of the surfaces of the fins are accelerated by the centrifugal force and the Coriolis force. As a result, the speed boundary layer to be formed on the surfaces of the fins becomes thinner and, consequently, the heat exchange efficiency is improved.

In this case, if that one end of each of the fins which functions as a fulcrum of vibration of the fins is set on an upstream side in the direction of flow of the fluid, the fluid gets agitated by the vibrations of the fins. The fluid is therefore accelerated in the direction of the flow of the fluid, and the fluid flows without giving rise to the flow velocity deficit up to (or as far down to) those fins which are positioned on a downstream side in the direction of flow of the fluid, resulting in a further improvement in the heat exchange efficiency. In order to vibrate the fins as described above, the following arrangement may be employed. Namely, either a piezoelectric material layer is laminated on each of the fins to thereby apply an alternative voltage (AC voltage) such that the piezoelectric material layer expands and contracts or a weight is provided to the other end of each of the fins and the heat exchange members are vibrated in the direction perpendicular to the heat exchange members.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

The illustrated embodying examples are ones in which the present invention was applied to a heat exchanger which comprises an evaporator for an air conditioner.

The heat exchanger is provided with a zigzag refrigerant tube 1 and heat exchange members 2 which are mounted in a stacked manner in clearances between respective zigzag bent portions of the refrigerant tube 1.

Figure 1:
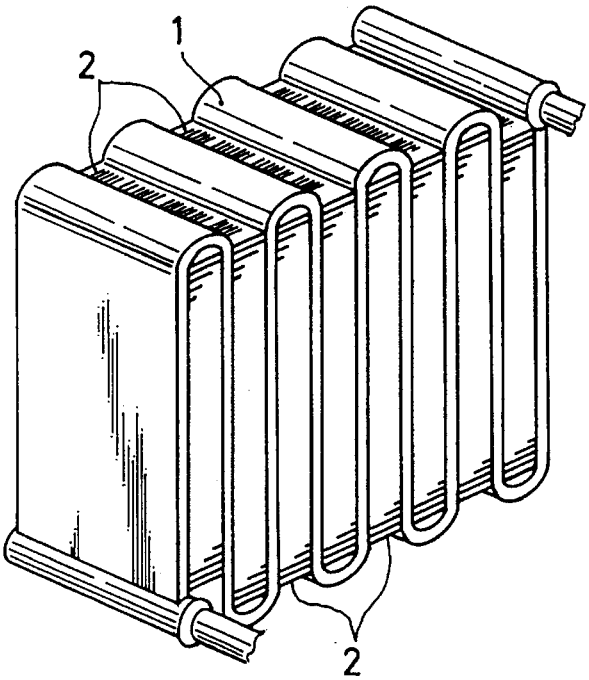
FIG. 1 is a perspective view of an example of a heat exchanger to which the present invention is applied.
Figure 2:
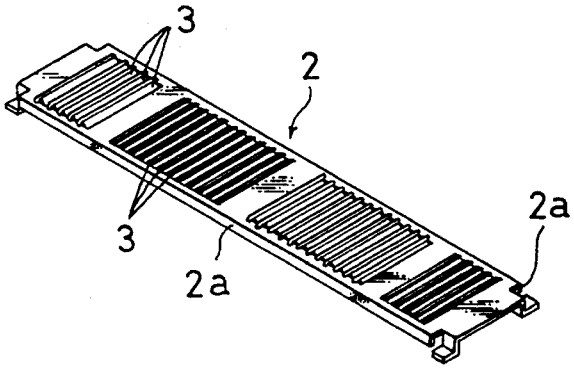
FIG. 2 is a perspective view of a heat exchange member which is provided in the heat exchanger in FIG. 1.
Figure 14:
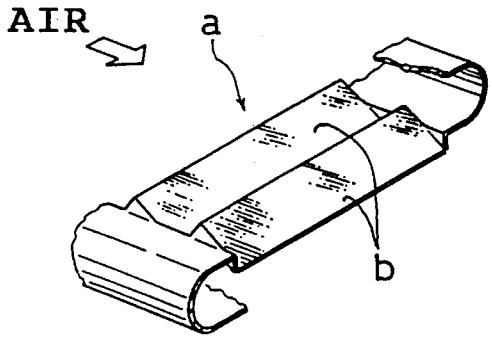
FIG.14 PRIOR ART
FIG. 14 is a perspective view of an important portion of a conventional heat exchange member.

Each of the heat exchange members 2 is formed, as shown in FIG. 2, in a manner to be elongated in the direction of the air flow, and is connected or adhered to the refrigerant tube 1 at its side edge portions 2*a* with a thermally conductive adhesive agent or by means of brazing. In the heat exchange member 2, there are formed a larger number of fins 3 in the form of louvers. The fins b of the conventional heat exchange member "a" as shown in FIG. 14 are adhered over their entire length of their side ends to the side edge portions of the heat exchange member. In the examples of the present invention, on the other hand, only a front portion of the side ends of each fin 3 is adhered to the side edge portions 2*1* of the heat exchange member 2, and the rear portion thereof is separated from, or left free of, the side edge portions 2*a* of the heat exchange member 2. The fins 3 are thus mounted on the heat exchange member 2 in a cantilevered manner with an upstream side in the direction of the air flow being made a fixed end.

Figure 3A:
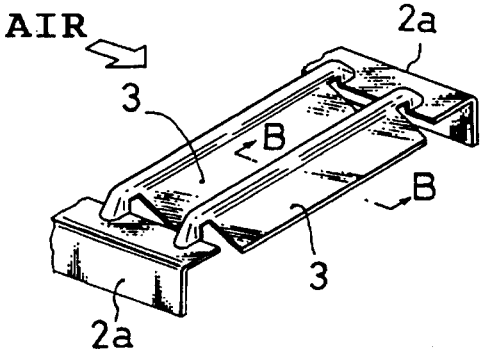
FIG. 3A is a perspective view of an important portion of the heat exchange member in FIG. 2.
Figure 3B:
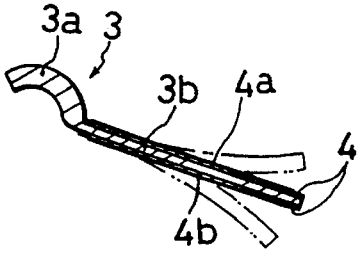
FIG. 3B is a sectional view taken along the line B—B in FIG. 3A.

The fins 3 are made of an aluminum alloy which is integral with each of the heat exchange members 2. As shown in FIG. 3B, the leading edge is formed into a thick (e.g., 0.25 mm) and rigid portion 3*a* and the trailing edge is formed into a thin (e.g., 0.01 mm) and flexible portion 3*b*. On each surface of the flexible portion 3*b*, there is laminated a layer of a piezoelectric material or a piezoelectric material layer 4 which is made of a piezoelectric polymer or the like. On each outer surface of the piezoelectric material layers 4, there is formed an aluminum metallized film 4*a*, 4*b* of about 500 Å. It is thus so arranged that each of the piezoelectric material layers 4 is expanded and contracted in an antiphase, i, e., in a phase opposite to each other in the direction of the flow of the air by charging an alternating voltage or AC voltage between each of the aluminum metallized films 4*a*, 4*b* and the fin 3 by means of an unillustrated oscillator.

Figure 10:
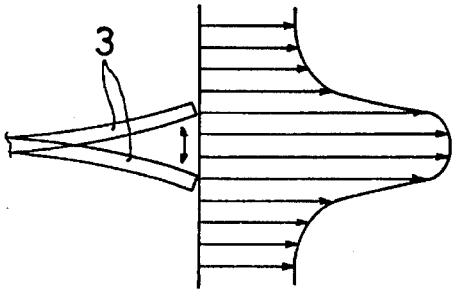
FIG. 10 is a diagram showing the flow speed distribution as a result of vibration of the fin.

According to this arrangement, the flexible portion 3*b* of the fin 3 is vibrated as shown by imaginary lines in FIG. 3B with the front end thereof operating as a fulcrum. The gas molecules in the neighborhood of the surfaces of the fins 3 are accelerated by a centrifugal force and a Coriolis force, with the result that the speed boundary layer becomes thinner and that the air is accelerated rearwards by getting agitated. Consequently, the speed distribution speeded up in the shape of a fountain as shown in FIG. 10 can be obtained. It follows that the air flows also up to (or as far down to) those fins 3 which are positioned on the downstream side in the direction of the flow of the air without giving rise to the flow speed deficit, resulting in a large overall improvement in the heat exchange efficiency of the heat exchange members 2.

The rigid portion 3*a* of the fin 3 contributes to the stabilization of the vibration mode.

Figure 11:
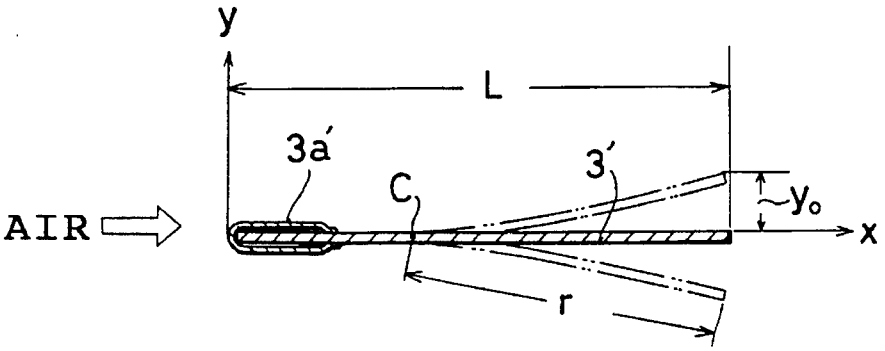
FIG. 11 is a sectional view of a vibration plate used in a test.

By using a vibration plate 3' which is laminated on both surfaces thereof with piezoelectric material layers and which is reinforced at its leading edge with a stiffener 3*a'* as shown in FIG. 11, the following two items were measured, i.e., the speed distribution in the direction normal to a vibration plate 3' (i.e., in a y-axis direction) at the time when the air was allowed to flow in parallel with the vibration plate 3' by using the vibration plate 3' which , as well as a Nusselt number Nu at each point in the longitudinal direction (in an x-axis direction) of the vibration plate 3'. The total width L of the vibration plate 3' was 20 mm and the width of the stiffener 3*a'* was 4.5 mm. The speed distribution was measured by an LDV (laser doppler velocimeter) and the Nusselt number was measured by a Mach-Zehnder interferometer.

Figure 12:
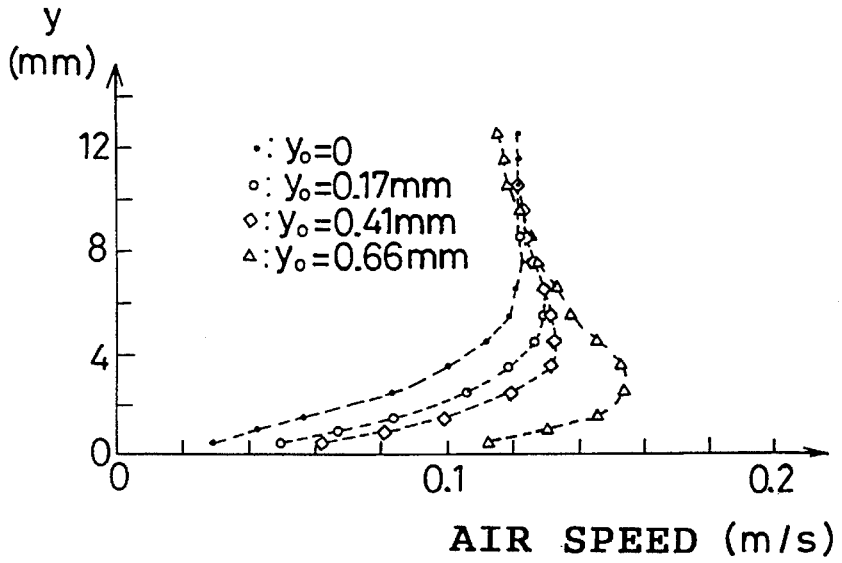
FIG. 12 is a graph showing the results of measurement of flow speed distribution.
Figure 13:
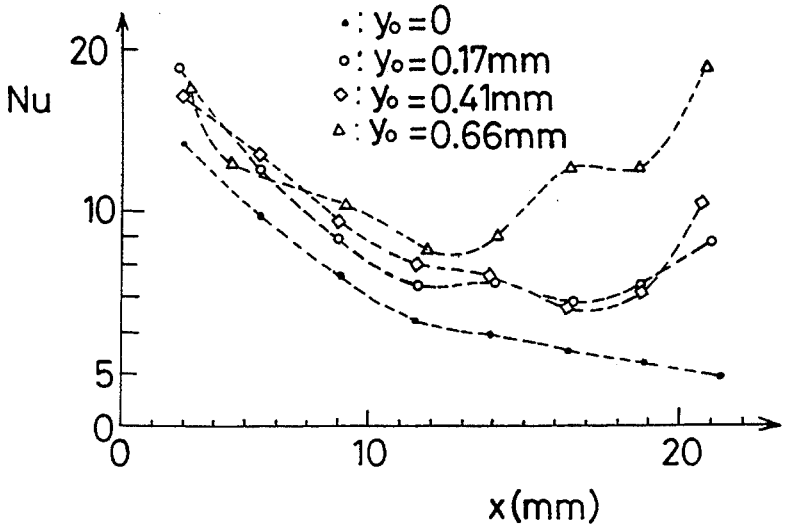
FIG. 13 is a graph showing the results of measurement of Nusselt number.

As the result of the measurements, it has been found out that the speed distribution varies with the amplitude $y_0$ of the vibration plate 3'. The relation between the speed distribution at a point 15 mm from the leading edge of the vibration plate 3' and the amplitude is shown in FIG. 12. It has also been found out that the Nusselt number varies with the amplitude of the vibration plate 3' as shown in FIG. 13. The air inflow speed U was set to about 0.12 m/sec so as to suit the air flow speed in an actual heat exchanger, and the frequency f of the vibration plate 3' was set to 71 Hz.

Here, the elastic vibrations of the vibration plate 3' are approximated as the rotational vibrations about a point C as shown in FIG. 11. Let the angular velocity of the elastic vibration be ω, the rotational degree of rotational vibrations be Ω, and the distance from the point C to the rear end of the vibration plate 3' be r. Then the following formula can be established $$\Omega=\{y_0\omega \cos(\omega t)\}/r$$

where r=aL, and "a" is a constant which is 0.759 in the case shown in FIG. 11.

Then, the Rossby number $R_0$ is considered. $R_0$ which is defined by the following formula $$R_0=U/2\Omega r$$

represents the ratio between the inertial force and the Coriolis force. Since Ω periodically changes, its rms value $$\Omega rms=(y_0\omega/r)/\sqrt{2} \quad (1)$$

is used to obtain the value $R_0$. Then, $$R_0=U/2\Omega rms L \quad (2)$$

Let the frequency of the vibration plate 3' be f and then $\omega=2\pi f$. Further, since r=aL, formula (2) can be rearranged by substituting the above into formula (1) as follows $$R_0=aU/2\sqrt{2}\,\pi y_0 f \quad (3)$$

Once $1/R_0>1$, the effect of Coriolis force can no longer be negligible. As shown in FIGS. 12 and 13, when the amplitude $y_0$ becomes 0.66 mm or more, the effects of acceleration and heat transfer promotion become remarkable. This is considered to be due to the influence of the Coriolis force. Here, when the value of $R_0$ is obtained in the case of U=0.12 (m/sec), $y_0$=0.66 (mm), f=71 (Hz) and a=0.759, the value will be $R_0$=0.186. Therefore, if the amplitude and the frequency of the fins 3 are increased or decreased such that the value $R_0$ becomes equal to or smaller than the above-described value, depending on the air inflow speed U, the effects of acceleration and promotion of heat transfer can be obtained to a remarkable degree.

It is preferable to set the amplitude of the flexible member 3*b* of the fin 3 to about 1/10 through 1/20 of the longitudinal width of the fin 3. Further, it is preferable to form the piezoelectric material layer 4 in a thickness of the order of microns (e.g., 5–9 μm) so as not to impair the heat transfer between the air and the base material of the fin 3.

Figure 4A:
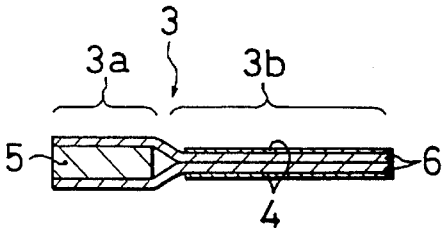
FIG. 4A is a sectional view of a second embodiment of a fin.
Figure 4B:
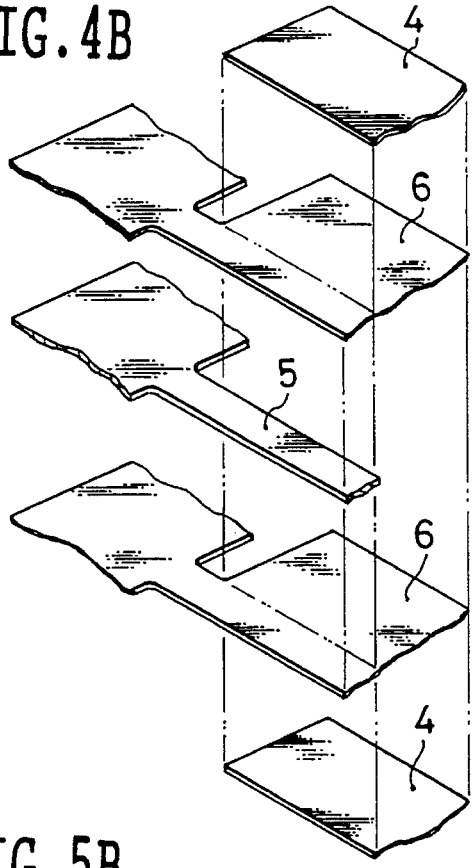
FIG. 4B is an exploded perspective view of the fin.
Figure 5A:
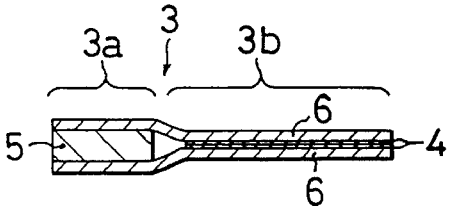
FIG. 5A is a sectional view of a third embodiment of the fin.
Figure 5B:
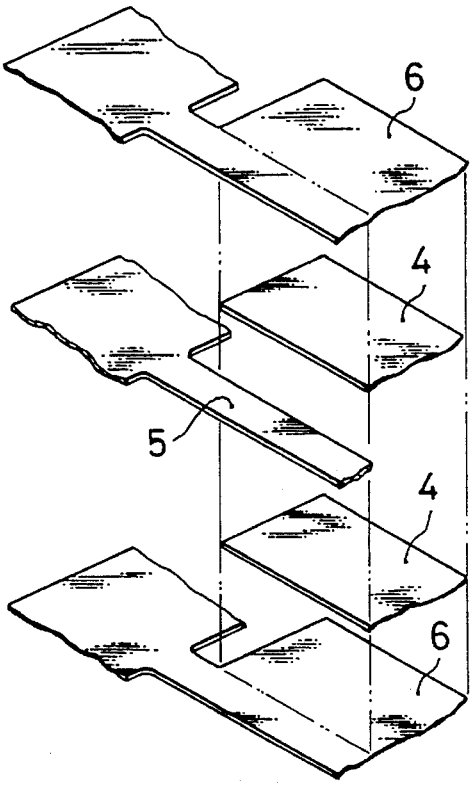
FIG. 5B is an exploded perspective view of the fin.
Figure 6A:
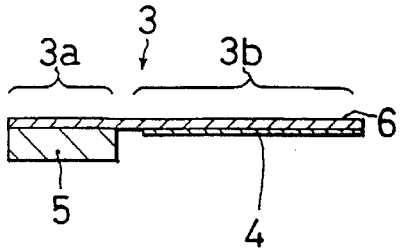
FIG. 6A is a sectional view of a fourth embodiment of the fin.
Figure 6B:
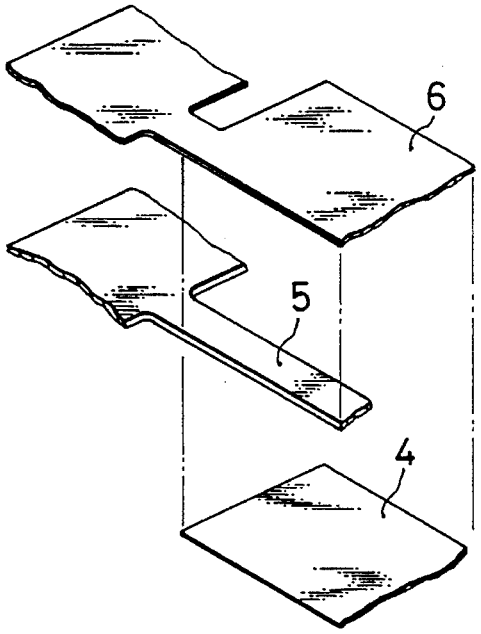
FIG. 6B is an exploded perspective view of the fin.

In the above-described example, each of the fins 3 was integrally formed to extend from the rigid portion 3*a* to the flexible portion 3*b*. However, the following arrangement may also be employed. Namely, as shown in FIGS. 4A and 4B, the rigid portion 3*a* is constituted by a plate member 5 of smaller width such as of titanium or the like, and the flexible portion 3*b* is constituted by metallic foils 6 of larger width such as of aluminum or the like such that the front end of each of which is connected to the rigid portion 3*a*, and thereafter the piezoelectric material layer 4 is laminated on each of the flexible portions 3*b*. In this arrangement, each flexible portion 3*b* is constituted by arranging the metallic foils 6 in two plies, and the piezoelectric material layer 4 is laminated on both surfaces of the flexible portion 3*b*. However, like in the embodying example as shown in FIGS. 5A and 5B, the piezoelectric material layers 4 may be laminated in two plies between the metallic foils 6, 6. According to this arrangement, it is advantageous in that a direct heat exchanging takes place between the air and the metallic foils 6, 6 which serve as the heat transfer base materials. Furthermore, as shown in FIGS. 6A and 6B, the metallic foil 6 may be provided in a single piece or sheet and the piezoelectric material layer 4 may be laminated only on one surface thereof.

Figure 7:
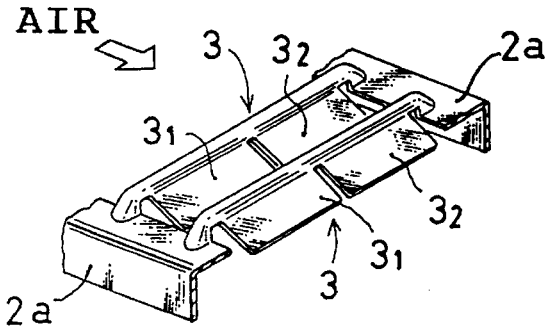
FIG. 7 is a perspective view of a fifth embodiment of the fin.

By the way, when the fins 3 are vibrated, the vibrations may sometimes leak or be transmitted to the side edge portions 2*a* of the heat exchange members 2. In this case, if each of the fins 3 is divided into sections in the direction perpendicular to the direction of the flow of the air so that one $\mathbf{3}_1$ of the divided fin and the other $\mathbf{3}_2$ of the divided fin are caused to vibrate in an antiphase, i.e., in a phase opposite to each other, the vibration force of one of the divided fins $\mathbf{3}_1$, $\mathbf{3}_2$ is advantageously canceled or counterbalanced by that of the other of the fins $\mathbf{3}_1$, $\mathbf{3}_2$. In this embodying example each of the fins 3 is divided into two parts, but it may be divided into three or more parts. In this case, the division is made into two sets or groups such that the mass of the fins in one divided set becomes equal to the mass of the fins in the other divided set so that one set of the divided fins is caused to vibrate in an antiphase, i.e., in a phase opposite to that of the other set. The embodying example shown in FIG. 7 corresponds to the one in which each set of the divided fins is made up of one piece of divided fin. Each of the divided fins $\mathbf{3}_1$, $\mathbf{3}_2$ shall be, as in the above-described examples, the one in which piezoelectric material layers are accordingly laminated.

Figure 8:
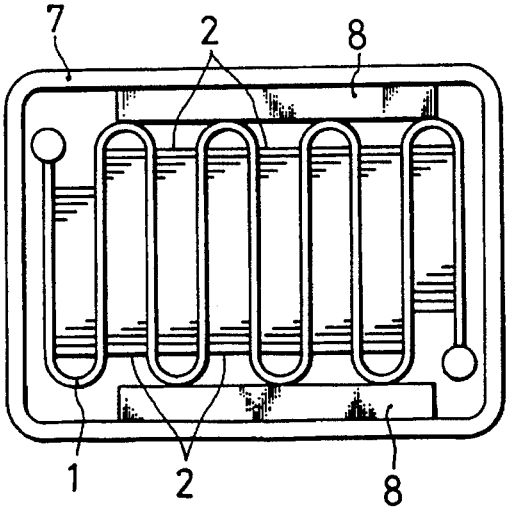
FIG. 8 is a front view showing a modified embodiment of the heat exchanger.

FIG. 8 shows still a modified example of the present invention, in which, inside a frame 7 which is provided so as to enclose the heat exchanger, there are disposed laminated type of piezoelectric actuators 8, 8, as a vibrating means, in a vertical (up and down) pair so as to pinch the heat exchanger in a vertical direction (i.e., from up and down). Each of the actuators 8 is charged with an alternate voltage by an unillustrated oscillator in a phase which is different from each other by 180 degrees so that the heat exchange members 2 can be vibrated in the vertical direction, i.e., in a direction perpendicular to the heat exchange members 2.

During the vibration, the frame 7 functions as a balance weight to thereby prevent the vibrations from leaking.

Figure 9A:
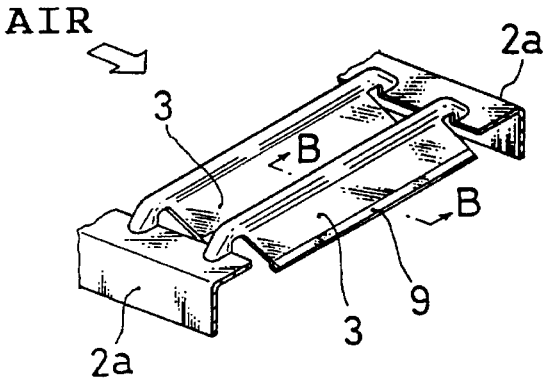
FIG. 9A is a perspective view of an important portion of a heat exchange member to be provided in the heat exchanger in FIG. 8.
Figure 9B:
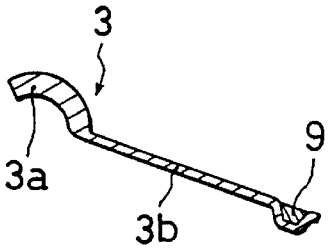
FIG. 9B is sectional view taken along the line B-B in FIG. 9A.

In each of the heat exchange members 2 there are provided fins 3 having, as shown in FIG. 9, a rigid portion 3*a* on the front end side and a flexible portion 3*b* in a cantilevered manner with the front end side working as a fixed end. There is further provided a weight 9 on the rear end of each of the flexible portions 3*b*. This weight 9 is constituted by a brazing filler metal which is filled into a trough portion formed in the rear end of the flexible portion 3*b*.

If the heat exchange members 2 are vibrated by the actuators 8 as described above, the fins 3 are stably vibrated with the front end side thereof working as a fulcrum through the operation of the weights 9. The heat exchange efficiency can be improved through the same operation as in the above-described examples.

An explanation has so far been made about the embodying examples in which the present invention was applied to the heat exchanger in which the air flows along the heat exchange members 2. The present invention can also, be applied to a heat exchanger in which a fluid other than air is caused to flow.

As can be seen from the above explanations, according to the present invention, the heat exchange efficiency can be improved by causing the speed boundary layer to become thinner due to the vibrations of the fins. If an arrangement is further made such that the fins are caused to be vibrated with its up stream side in the direction of the flow of the fluid functioning as a fulcrum, the fluid can flow also up to (or as far down to) those fins which are positioned on the downstream side in the direction of the flow of the fluid without giving rise to the occurrence of the flow speed deficit, with the result that the heat exchange efficiency can further be improved. Furthermore, the pressure loss which occurs in the fins can apparently be eliminated.

It is readily apparent that the above-described heat exchanger meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A heat exchanger having heat exchange members for exchanging heat with a fluid flowing along surfaces of said heat exchange members, comprising:

plurality of fins with each fin having a rigid portion which includes a plate member integrally attached to a flexible portion which includes at least one metallic layer and at least one piezoelectric material layer, said rigid portion having ends which extend outwardly from sides of said flexible portion and which are fixed to respective side edge portions of said heat exchange members so that said flexible portion is supported in a cantilevered manner; and means for vibrating said flexible portion of each fin of said plurality of fins such that said rigid portion of each fin of said plurality of fins operates as a fulcrum.

2. The heat exchanger according to claim 1, wherein said vibrating means comprises:

said at least one piezoelectric material layer which is laminated on each fin of said plurality of fins; and voltage applying means for applying an alternating voltage to said at least one piezoelectric material layer such that said at least one piezoelectric material layer expands and contracts.

3. The heat exchanger according to claim 2, wherein said at least one piezoelectric material layer is laminated on first and second surfaces of each fin of said plurality of fins, and wherein said voltage applying means is arranged such that said alternating voltage is applied, in an antiphase, to said at least one piezoelectric material layer laminated on said first surface of each fin of said plurality of fins and to said piezoelectric material layer laminated on said second surface of each fin of said plurality of fins.

4. The heat exchanger according to claim 1, wherein each fin of said plurality of fins is constituted by a plurality of divided fins which are divided in a direction perpendicular to a direction of flow of said fluid such that said divided fins are grouped into a first and second set of fins, and wherein said means for vibrating is arranged to vibrate said first set of divided fins and said second set of divided fins in an antiphase.

5. The heat exchanger according to claim 1, wherein said ends of said rigid portion of each fin of said plurality of fins are fixed to an upstream side in a direction of flow of said fluid.

* * * * *

UNITED STATES PATENT AND TRADEMARK OFFICE

CERTIFICATE OF CORRECTION

PATENT NO. : 5,558,156
DATED : September 24, 1996
INVENTOR(S) : TSUTSUI, Toshihiro It is certified that error appears in the above-indentified patent and that said Letters Patent is hereby corrected as shown below:

On the title page
Item [73], after "KABUSHIKI" insert --KAISHA--.

Column 6, claim 1, line 4, before "plurality" insert --a--.

Signed and Sealed this
Fourth Day of March, 1997

*Attest:*

*Attesting Officer*

BRUCE LEHMAN

*Commissioner of Patents and Trademarks*